US009564041B1

(12) United States Patent
Dedeaux

(10) Patent No.: US 9,564,041 B1
(45) Date of Patent: Feb. 7, 2017

(54) METHOD AND APPARATUS FOR SECURING A FACILITY

(71) Applicant: Clifton Eugene Dedeaux, Gulfport, MS (US)

(72) Inventor: Clifton Eugene Dedeaux, Gulfport, MS (US)

( * ) Notice: Subject to any disclaimer, the term of this patent is extended or adjusted under 35 U.S.C. 154(b) by 185 days.

(21) Appl. No.: 14/605,464

(22) Filed: Jan. 26, 2015

(51) Int. Cl.
*G08B 25/01* (2006.01)
*G08B 25/00* (2006.01)
*G08B 5/22* (2006.01)

(52) U.S. Cl.
CPC ..... *G08B 25/009* (2013.01); *G08B 5/22* (2013.01)

(58) Field of Classification Search
CPC ..... G08B 2/22; G08B 25/009; G08B 25/016
USPC ..... 340/287, 539.11, 539.16
See application file for complete search history.

(56) References Cited

U.S. PATENT DOCUMENTS

| | | | | |
|---|---|---|---|---|
| 3,694,579 | A | 9/1972 | McMurray | |
| 6,822,568 | B2 | 11/2004 | Gehlot et al. | |
| 7,053,770 | B2 * | 5/2006 | Ratiu | G05B 23/027 340/539.1 |
| 7,652,571 | B2 * | 1/2010 | Parkulo | G01S 13/878 340/525 |
| 7,751,285 | B1 | 7/2010 | Cain | |
| 7,880,610 | B2 | 2/2011 | Tanner et al. | |
| 8,384,549 | B2 | 2/2013 | Lemmon | |
| 2007/0077959 | A1 | 4/2007 | Newman et al. | |
| 2007/0296575 | A1 | 12/2007 | Eisold et al. | |
| 2008/0001735 | A1 * | 1/2008 | Tran | G06F 19/3418 340/539.22 |
| 2010/0141428 | A1 * | 6/2010 | Mildenberger | G08B 25/009 340/539.11 |
| 2012/0212339 | A1 | 8/2012 | Goldblatt | |

FOREIGN PATENT DOCUMENTS

| | | |
|---|---|---|
| CA | 2308577 | 5/1999 |
| WO | WO2014/132272 | 9/2014 |

* cited by examiner

*Primary Examiner* — Albert Wong
(74) *Attorney, Agent, or Firm* — George L Williamson

(57) ABSTRACT

Method and apparatus for a security alert system for communicating a security event to users by means of a full mesh network topology. The mesh network includes a plurality of remote units, receiver units, emergency box units, and teacher/hallway units strategically placed throughout a facility. Each remote unit has a plurality of buttons thereon wherein a button is designated for a specific type of problem, for example, an intruder, a gun carrying intruder, a medical emergency, or a fight. If a user presses one of the designated buttons the other members of the mesh network, including a receiver unit being monitored by security personnel, are immediately notified of the type and the location of the problem within the facility.

22 Claims, 3 Drawing Sheets

METHOD AND APPARATUS FOR SECURING A FACILITY

BACKGROUND OF THE INVENTION

Field of the Invention

The present invention relates generally to security systems and, more particularly, is concerned with a method and apparatus for securing a facility such as a school building.

Description of the Related Art

Devices relevant to the present invention have been described in the related art, however, none of the related art devices disclose the unique features of the present invention.

In U.S. Patent Application Publication No. 2012/0212339 dated Aug. 23, 2012, Goldblatt disclosed a concealed personal alarm and method. In U.S. Patent Application Publication No. 2007/0077959 dated Apr. 5, 2007, Newman, et al., disclosed an electronic locator. In U.S. Pat. No. 7,751,285 dated Jul. 6, 2010, Cain disclosed a customizable and wearable device for electronic images. In U.S. Pat. No. 7,880,610 dated Feb. 1, 2011, Tanner, et al., disclosed a system and method that provide emergency instructions. In U.S. Pat. No. 8,384,549 dated Feb. 26, 2013, Lemmon disclosed an event communication system for providing user alerts. In U.S. Patent Application Publication No. 2007/0296575 dated Dec. 27, 2007, Eisold, et al., disclosed a disaster alert device, system and method. In U.S. Pat. No. 6,822,568 dated Nov. 23, 2004, Gehlot, et al., disclosed a space area network. In U.S. Pat. No. 3,694,579 dated Sep. 26, 1972, McMurray disclosed an emergency reporting digital communications system. In Canadian Patent No. CA 2,308,577 dated May 27, 1999, Shamim Ahmad disclosed a security and emergency alarm system. In WIPO International Publication No. WO2014/132272 dated Sep. 4, 2014, Anand Sundararaj disclosed a method and system for optimal emergency communication.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a security system for communicating a security threat or event to all users by means of a full mesh network topology. The mesh network comprises a plurality of remote units, receiver units, emergency box units, and teacher/hallway units strategically placed throughout a facility. Each remote unit has a plurality of buttons thereon wherein a button is designated for a specific type of problem, for example, an intruder, a gun carrying intruder, a medical emergency, or a fight. If a user presses one of the designated buttons the other members of the mesh network, including a receiver unit being monitored by security personnel, are immediately notified of the type and the location of the threat within the facility. The remote units are expected to be worn by the users located throughout a facility, e.g., a school building, wherein if an intruder, e.g., is observed the user can actuate one of the buttons on the remote unit designated for intruders and all the other member devices of the mesh network will immediately be notified of the intrusion.

An object of the present invention is to provide a rapid response system for emergencies related to security of a facility. A further object of the present invention is to provide a security system which notifies security personnel of the type of emergency along with the specific location of the emergency. A further object of the present invention is to provide a security system which can be used to notify users that the facility is free of security problems and that school children, for example, can be evacuated from the facility. A further object of the present invention is to provide a security system which can be easily operated by a user. A further object of the present invention is to provide a security system which can be relatively easily and inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
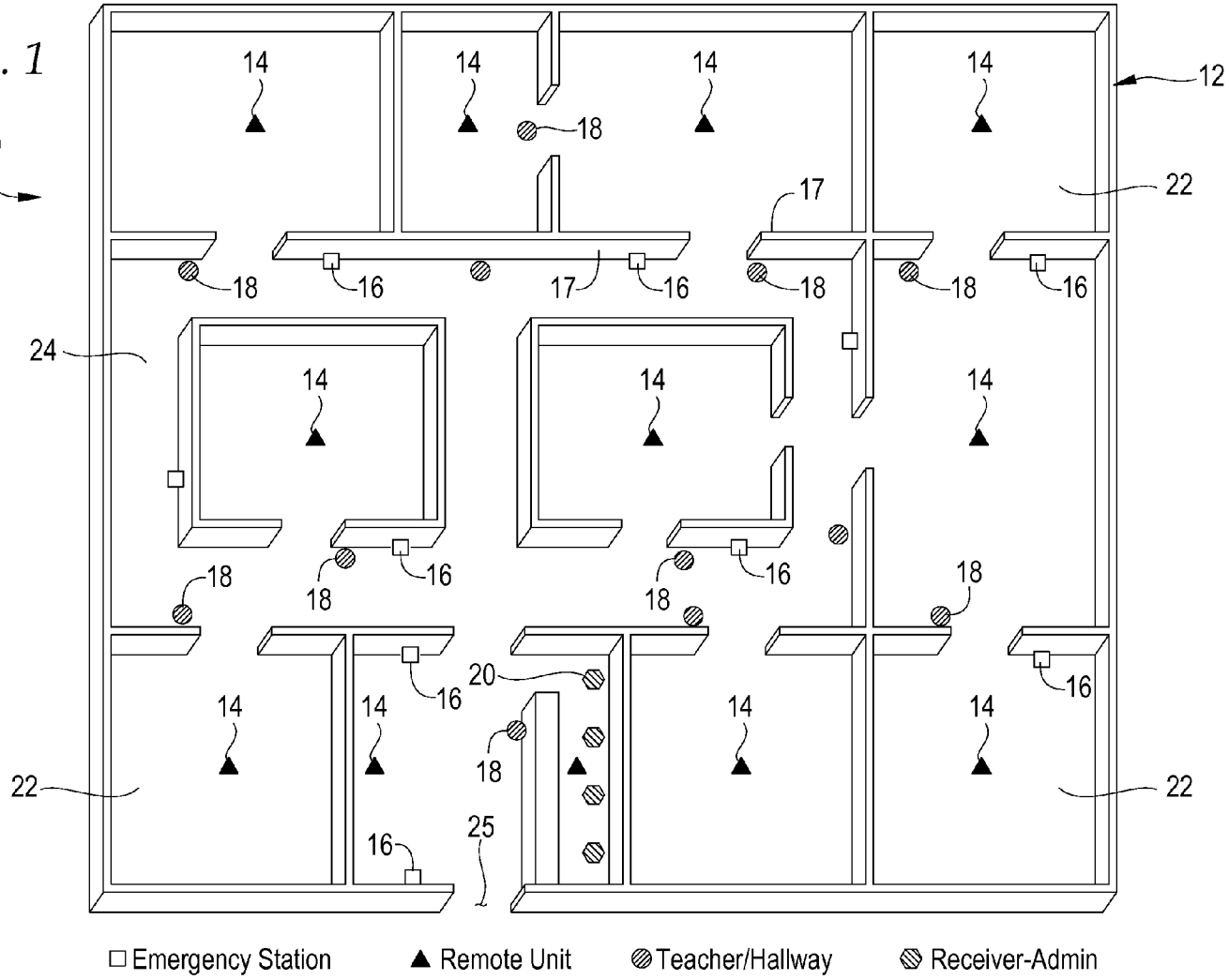
FIG. 1 is a plan view of an exemplary facility showing users positioned about the facility.

With regard to reference numerals used, the following numbering is used throughout the drawings.

10 present invention
12 building/facility
14 remote unit
16 emergency box unit
17 wall
18 teacher/hallway unit/user
20 receiver unit
22 room
24 hallway
25 entrance
26 mesh network
28 member of mesh network
30 line of communication
32 user
34 lanyard

36 enclosure
38 cover
39 inside cover
40 front face
42 hinge
44 written message
46 display
48 row of buttons
50 numbers 1-0
52 row of buttons
54 alphabet A-Z
56 EV button
58 reset button
60 battery tester button
62 speaker vents
64 slot for memory card
66 memory card
68 enclosure of remote
70 front face
72 cover
74 hinge
76 message
78 inside of cover
80 display
82 button
84 button
86 button
88 button
90 stickman symbol
92 firearm symbol
94 fight symbol
96 medical emergency symbol
98 lanyard hasp
100 outside of cover
102 photo ID
104 green evacuation button
106 battery tester button
108 door
110 hinge
112 message/instructions
114 inside front
116 enclosure
117 flashing light
118 fastener
120 tamper proof switch

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 8 illustrate the present invention wherein a security system for a facility is disclosed and which is generally indicated by reference number 10.

Figure 3:
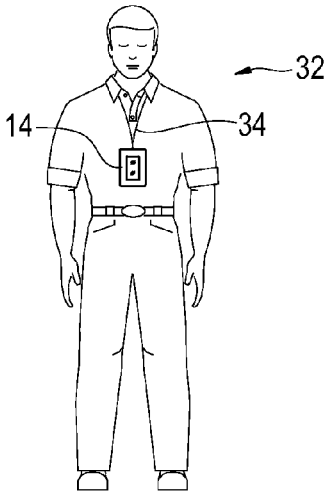
FIG. 3 is an illustration of a user of the present invention.

Turning to FIG. 1, therein is shown an exemplary layout of the basic components of the present invention 10 in use and positioned in an exemplary facility or building 12, for example, a school building, an office building, or a manufacturing complex or the like. Shown are a plurality of remote units 14 disposed throughout the facility wherein the remote unit is expected to be worn about the neck of a user as best shown in FIG. 3. Also shown in FIG. 1 are a plurality of emergency box units 16 which are expected to be placed on a wall(s) 17 of the facility 12 and strategically located in the facility in places such as hallways. Also shown are a plurality of teacher/hallway users/units 18 (these are users carrying remote units 14) which are likewise strategically placed about the facility 12 so that the user would be able to observe high traffic areas where an emergency event is more likely to happen. Also shown are a plurality of receiver units 20 which are expected to be placed in an administrative portion of the facility 12 such as a main office where the receivers can be monitored by dedicated security personnel. The building 12 contains numerous smaller rooms 22 and hallways 24 along with an entrance 25 and is meant for illustration only because it would be clear to one skilled in the an that the present invention 10 is useful for all types of facilities.

Figure 2:
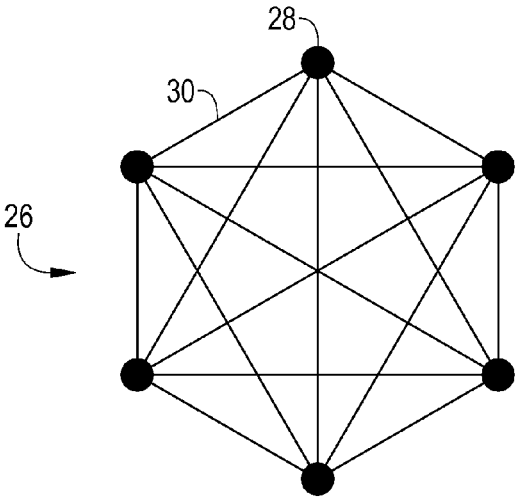
FIG. 2 is an illustration of a full mesh network.

Turning to FIG. 2, therein is shown a conventional, full mesh wireless network topology 26 having individual member units or nodes 28 which would each be functioning units of the mesh network wherein the previously disclosed units 14, 16, 18, 20 of the present invention 10 are members of the network. A characteristic of mesh networks is that each member 28 communicates with each other member wherein the line of communication is illustrated by line 30 which is intended to be illustrative of an electronic, wireless means of communication between members of the mesh network. For example, if a button 82 or like user activation mechanism on remote unit 14 is actuated by a user, a signal would be sent wirelessly to each other member 28 of the network 26 including remote units 14, emergency box units 16, teacher/hallway units 18 and receiver units 20. Each unit/member 28 has a computer or central processing unit capable of processing the required information for the network 26 to function properly which would include, but not be limited to, information about the type or identification, location, time, and type of emergency or security threat occurring and any other information necessary for the proper functioning of the network as hereinafter disclosed. Also, the computer or central processing unit may require some sort of input device, e.g., keyboard, mouse, or the like, for programming or inputting data into the computer; the computer may also require related memory and software or other components as required for proper operation of the network 26, all of which would be done in the standard manner by one skilled in the art. The present invention 10 would be designed for any size of network 26 having up to 100-200 nodes 28 or more.

Figure 6:
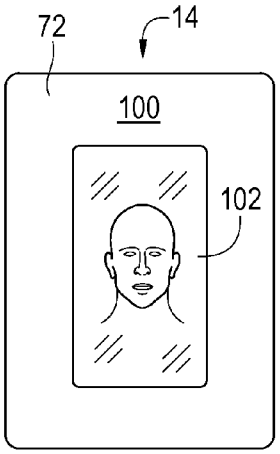
FIG. 6 is a front view of a remote unit of the present invention.

Turning to FIG. 3, therein is shown a typical user 32 of the present invention having a remote unit 14 being worn about his neck wherein the remote unit is suspended on a lanyard 34 as would be done in the standard manner by one skilled in the art. Remote unit 14 also serves as a photo ID as shown in FIG. 6. There are also other ways to attach unit 14 to user 32.

Figure 4:
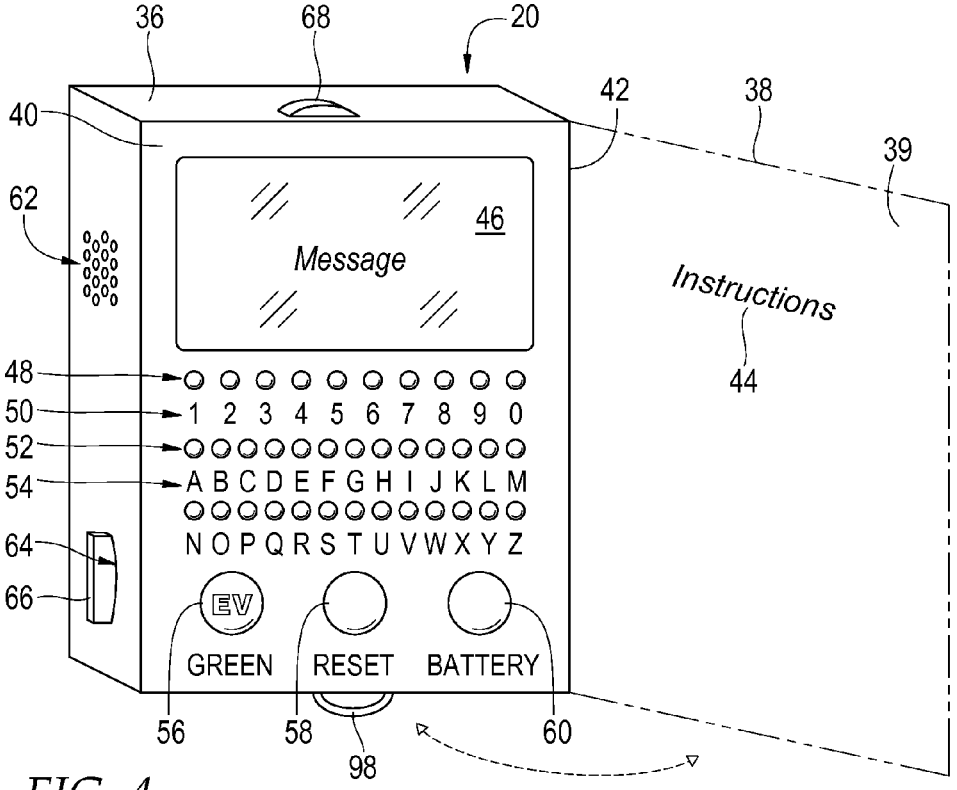
FIG. 4 is a perspective view of a receiver unit of the present invention.

Turning to FIG. 4, therein is shown a receiver unit 20 of the present invention 10 for being worn by a user in a facility as previously illustrated in FIG. 1 wherein the receiver is approximately three inches wide, four inches high and about two inches thick. The receiver 20 is shown for illustration purposes only as being generally rectangular shaped and having an enclosure 36 wherein the enclosure has a swingable flap or lid 38 on its front so as to provide security for the face 40 of the receiver wherein the flap 38 is hinged on one edge 42 so that it freely swings from an open to a closed position using the hinges and allowing for written operational instructions for the unit or other important written messages 44 in the form of text, drawings, or symbols or stickers to be placed on an inner face 39 of the flap or cover 38. Shown on the front 40 of the enclosure 36 is a screen or display 46 for displaying messages along with a row of buttons 48 or other actuators which are numbered from 1 to 0, as indicated by numeral 52, which would be assigned to individual rooms 22 of the present invention 10 as illustrated in FIG. 1, for example, along with rows of other buttons 50 having alphabetical letters from A-Z, as indicated by numeral 54, assigned thereto. Numerals 52 and/or letters 54 may alternatively be written directly onto the buttons 48, 50. Also shown on the front 40 of the receiver 20 is a green button 56 having the letters EV written on its front to indicate evacuation, a reset button 58 to clear all messages and a battery tester button 60, along with speaker vent holes 62 on the left side for emission of sound from an internal speaker and having an SD card or like memory card slot 64 for insertion or removal of a memory card 66 or the like along with a volume control button 68 on the top of the receiver; also, other forms of inputting memory into the receiver 20 may be used, e.g., flash drives, compact disks, external hard disk drives, universal serial bus ports or the like. Also shown is a lanyard hasp 98 on a lower end of the enclosure 36 so that the receiver 20 may be placed on a lanyard and worn about the neck of a user as illustrated in FIG. 3 and it may also serve as a photo ID as best shown in FIG. 6.

Figure 5:
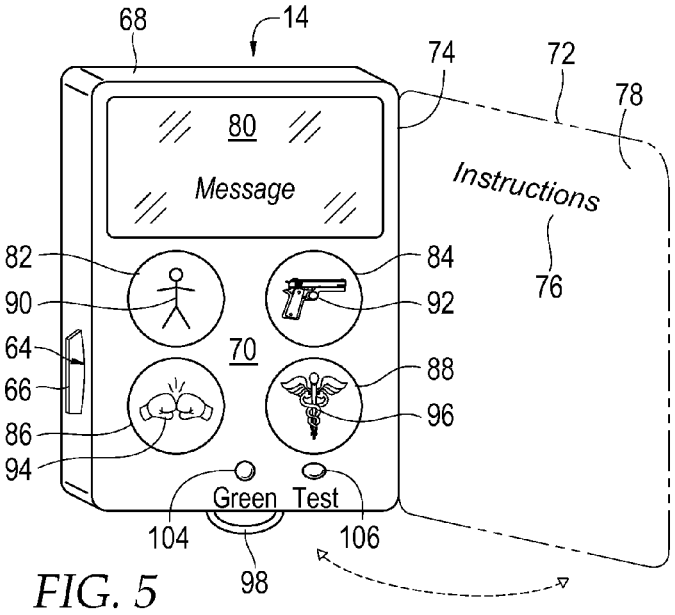
FIG. 5 is a perspective view of a remote unit of the present invention.

Turning to FIG. 5, therein is shown a remote unit 14 for being worn by a user 32 of the present invention 10 as previously illustrated in FIG. 1 wherein the remote has an enclosure 68 having a front face 70 thereon along with a swinging cover 72 being hinged on one side 74 and having operating instructions or other messages 76 inscribed on the inside 78 of the cover. Also shown on the front 70 is a screen or display 80 for messages along with individual buttons or like actuators wherein there are four buttons 82, 84, 86 and 88 wherein button 82 has a stickman symbol 90 thereon to indicate that an intruder is in the facility; button 84 has a firearm symbol 92 thereon to indicate that an armed intruder or a person with a weapon is in the facility, button 86 has a boxing gloves symbol 94 thereon to indicate that a fight has broken out in the facility; and button 88 has a medical symbol 96 thereon to indicate that there is a medical emergency in the facility. Also shown on enclosure 68 are a slot 64 for a memory card along with a memory card 66 or the like therein and a lanyard hasp 98 on a lower end of the enclosure 68 so that the remote 14 can be placed on a lanyard and worn about the neck of a user as illustrated in FIG. 3. Also, other forms, e.g., flash drives or the like, of inputting memory into the remote 14 may be used, Also shown on the front face 70 of the enclosure 68 are a green light 104 along with a battery test button 106 wherein when green light 104 turns on it indicates that an evacuation should take place.

Turning to FIG. 6, therein is shown a front face of remote unit 14 wherein the outside face 100 of the cover 72 is shown having a photo ID 102 attached thereto so that the user can be identified by using the photo ID.

Continuing with FIGS. 5-6, the four-button remote unit 14 which users 32 may wear around their neck also has a flip lid or cover 72 to prevent a user from hitting the buttons accidentally. Also, the remote 14 holds a photo ID 102 holder and each remote will be programmed for each classroom, gym, field house, office, etc., of the facility 12. Each button will deliver its own distinct programmed message, e.g., intruder room 101, fight room 101, medical attention needed room 101, etc., which message will be sent to all other members of the network 26 including the offices, receiver, principal, assistant principal, etc. This will let responders know within seconds where, i.e., the location, the incident is taking place for quick response times. When a user 32, such as a teacher, pushes a button, the remote 14 will vibrate twice or give a like signal letting the teacher know the message was picked up by a receiver unit 20 on the network 26. Other types of emergencies may occur which require evacuation of the students room by room. The officer or swat team, can press the green evacuation button 56 on the receiver unit 20 after they enter the classroom number and a green light 104 will appear on the teacher's remote 14 to let her know it is okay to evacuate the students. Also, when a message is sent from a remote 14, all other remotes 14 and receivers 20 in the network 26 are adapted to give a signal or visual/auditory alert, e.g., vibration, noise, beep, light or the like, that a message is coming through. It should be clear to one skilled in the art, that the present invention 10 could be designed to operate substantially silently if desired, i.e., without beeping or making similar audible noises.

It can be seen that the present invention 10 provides a tool to help minimize response time to the threat and save lives during an active shooting, hostage, fight or medical situation on a school campus which situations are among the top threats that occur in schools. Further, the present invention 10 is very basic and simple as it operates on batteries using radio frequencies and the mesh network. There are no cell phone towers or land phone lines which is an advantage because with all the students having cell phones there is a possibility of overloading the phone tower, and, the same thing will happen to the telephone land lines caused by parents calling in to check on their children. In general, with a mesh network 26 utilizing a decentralized design as does the present invention 10, each node 28 of the network relays data for the network, thus, all nodes 28 cooperate in the distribution of the data in the network so that if a packet of information (e.g., a signal generated by actuating button 82 on remote unit 14) is transmitted through the network the packet travels to each member or node (from node to node) of the network until the packet finds the correct destination member or node, at which time an acknowledgement may be sent back through the network until it reaches the member or node from which the original signal was transmitted. Each node 28 functions as a transceiver transmitting radio-frequency signals. Further, the nodes 28 include computers which are programmed with software which instructs them about how to interact within the network 26 as a whole. Mesh networks are very reliable because there is typically more than one path between a source and a destination in the network. The present invention 10 can be used in schools, colleges, courthouses, buildings, manufacturing facilities, etc., and, its advantages over other conventional security systems include a quicker response time, the location of the emergency is provided, it is quiet and discreet, a user does not have to travel to an intercom, network wide notification is provided, and full mesh networks include enhanced security through greater reliability.

Figure 7:
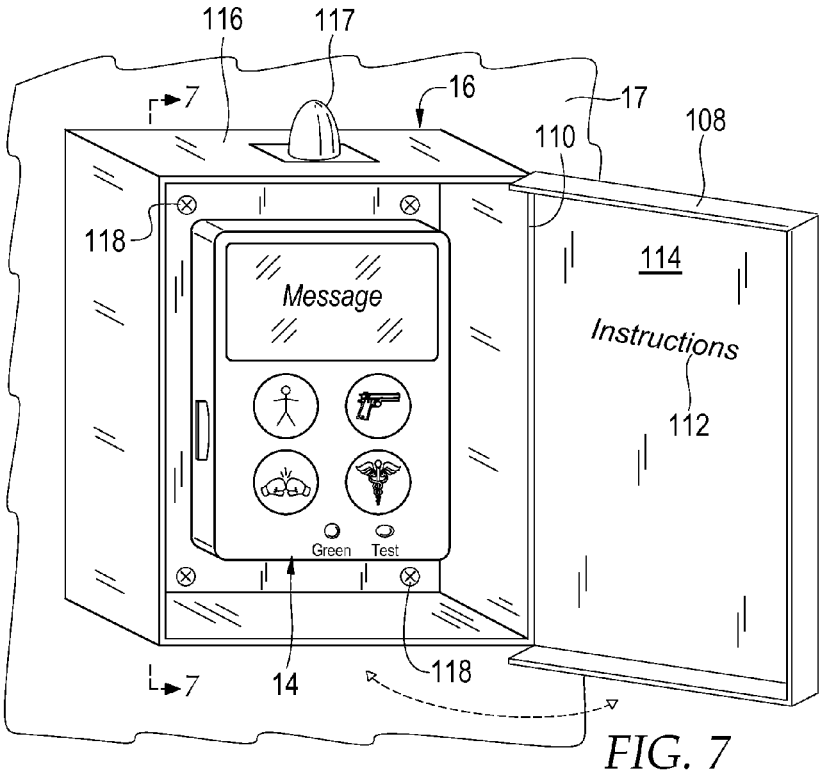
FIG. 7 is a perspective view of an emergency box unit of the present invention.

Turning to FIG. 7, therein is shown an emergency box unit 16 of the present invention 10 along with a wall 17 upon which the emergency box is mounted as previously illustrated in FIG. 1. Also shown is a hinged door 108 having hinges on a side 110 as would be done in the standard manner, wherein a message or instruction 112 can be written on the inside face 114 of the door as would be done in a conventional manner along with a remote unit 14 being housed inside enclosure 116 of the emergency box unit 16. A remote 14 is shown mounted inside the enclosure 116 of the emergency box 16 and it would be the same as the remote which has been previously described as a part of FIG. 5. Note, however, that an alternative to mounting a stand-alone remote unit 14 inside the enclosure 116 would simply be to provide the hardware/software capability of the remote unit inside the enclosure so as to provide the same functional capability of the remote unit therein without actually placing a stand-alone remote unit inside the enclosure. Also shown in FIG. 7 are mounting fasteners 118 that would be used to mount the enclosure 116 onto the face of the wall 17 of a building as previously illustrated in FIG. 1. An emergency flashing blue LED light 117 is shown on the top of the enclosure 116 to indicate when flashing that the internal remote unit 14 is transmitting a notice of an emergency. The emergency box station unit 16 of the present invention 10 can be placed throughout the school 12 on the wall 14 for emergency use. The box 16 will be a bright yellow color and about 5 inches high and 4 inches wide and will either have a teacher's emergency remote unit 14 installed inside the box or have the same hardware as a remote unit inside the box. The box 16 will be programmed for its specific location and will also have a small, blue, LED light 117 that blinks/flashes when a button on the internal remote unit 14 is activated which lets the emergency responders know they are at the correct location of the emergency.

Figure 8:
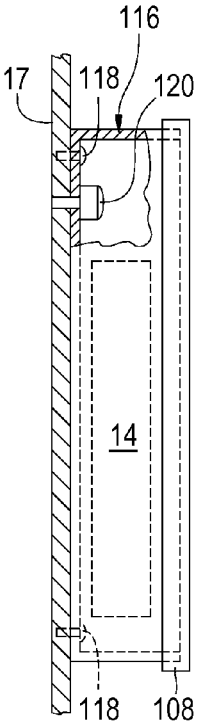
FIG. 8 is a cut-away side view of portions of the emergency box unit of the present invention.

Turning to FIG. 8, therein is shown a cut-away side view of the enclosure 116 showing some of the elements previously disclosed in FIG. 7 along with a tamper-proof button 120 which is spring-loaded so that if the emergency box 116 is knocked off of the wall 17 by an intruder an alarm would be sounded to indicate that the emergency box 16 had been knocked off of a wall along with giving the location of the particular emergency box.

Examples of situations wherein the present invention 10 may be useful follow and may make references to elements shown in FIGS. 1-8.

Example One

When a school or facility goes to a lockdown situation, classrooms are always locked and the teachers and students are instructed to be silent, sitting down in a corner of the classroom so the intruder thinks there are no students in the room and he will move to the next classroom or tries to make entry into the locked classroom. Using the silent buttons of the present invention 10, the teacher can push the button that is programmed for their room, convey the exact threat and the SRO will receive the type threat and exact classroom number and, very importantly, the location of the threat. The SRO response time will be much quicker and more lives will be saved, including the fact that the risk of an SRO being shot will drop. It is important that the principal knows about the threat, the type of threat, and the location of the threat. Most schools currently have conventional inner-corn or public address systems to order a lockdown that uses a bell tone or both. This lockdown procedure takes several minutes before the school is on total lockdown. When present invention 10 is activated by a teacher, all personnel are notified at the same time of the threat, what kind of threat, and location of the threat. This will reduce the time of the total school lockdown to seconds and also the response time to the threat to seconds. Without the present invention 10, the SRO or swat team member would have to go room to room in order to find the intruder.

Example Two

The present invention 10 will also be a great tool for the aftermath of an active shooter. For example, if the shooter is shot down but it is unknown if there are any more suspects involved and you have not received any more messages about any other intruder, the police or swat team has to go in and clear all the classrooms and all other rooms and buildings within the school campus. The present invention 10 has a green LED light on the teachers' emergency remote, and a green button on the receiving units of the SRO and staff. The police or swat team can go to each classroom one at a time to sweep the room clean, program the room number into the receiver, hit the green button to send to and activate the green light on the teacher's remote letting the teacher know it is safe and she can evacuate her students. This transaction will keep the swat team from having to rush into the classroom with guns out, yelling at the students and teacher who are already terrified due to the incident. Also, when the swat team sends the green light to the teacher to evacuate and there is an intruder in her classroom and the teacher can't use her panic remote and the teacher is not evacuating the students, this will tell the swat team that something is wrong and it will give the swat team time to reassess the situation. Anytime police or swat has to kick in and enter a room, there is a chance someone innocent could get hurt.

Example Three

This is another example using an active intruder school shooting that happened. Some teachers mistakenly thought the incident was a fire and released students to evacuate the school while the shooter was in the school. This is why it is very important for all the employers and administrators to know at the same time what kind of threat and the location of the threat they're facing. If this school had the present invention 10 installed, they would have known there was a shooter inside the school and the teachers could have gone into a lock down within seconds. Another advantage of the present invention 10 is that all the communication is by message and is silence, not over a PA system, and this will help the teachers keep better control and less panic with students. This will also present an element of surprise to the intruder due to a lock down being in place without the intruder hearing it over a PA intercom.

Example Four

Another example that happened was a second grader had fallen to the classroom floor with a seizure and the teacher could not leave the student and was unable to get to her classroom public address button which was located on the classroom wall and the button was too high up on the wall for the other second graders to push. The teacher sent a student to the office to report this medical problem, so now seconds are turning into several minutes for this teacher to get medical help for this child. With the present invention 10 around the teacher's neck, she could press the medical button to summons the school nurse, (SRO— police officer) principle, etc. and a medic unit within seconds.

I claim:

1. A security alert system for use in a facility having rooms, hallways, and other areas, comprising:

a) a remote unit carried by each of selected users in assigned areas of the facility, each said remote unit having a display for receiving messages, a button for sending a signal when actuated for a specific type of an emergency condition, each said remote unit being programmed to include a distinct programmed message identifying the assigned area when the button is actuated;

b) an emergency box unit mounted in each of a number of locations within the facility, each said emergency box unit having a display for receiving messages, a button for sending a signal when actuated for a specific type of an emergency condition, each said emergency box unit programmed for the specific location thereof, said emergency box unit having a light on an outside thereof to indicate when flashing that said emergency box unit is transmitting an emergency message thereby visually indicating to emergency responders that they have arrived at the location where the emergency message originates;

c) a receiver unit located within an administrative area of the facility to be monitored by security personnel and adapted for receiving and displaying all messages being transmitted from any unit, each message indicating which remote unit issued the message, said receiver unit having a display for receiving messages;

d) all of said units forming a mesh network wherein each unit is in wireless communication with all other units in said network so that all units receive and display all messages; and, e) wherein all of said units are adapted to be programmed to interact with all other units in said network.

2. The security alert system of claim 1, in which each said remote unit and each said emergency box unit has at least four buttons, a first button for indicating an intruder in the facility, a second button to indicate an incident involving a weapon, a third button to indicate a fight has broken out, and a fourth button to indicate a medical emergency.

3. The security alert system of claim 2, in which each said remote unit has a light to indicate when a message is received that an evacuation should take place.

4. The security alert system of claim 3, in which each said remote unit and each said receiver unit is adapted for inputting memory into said remote unit and said receiver unit.

5. The security alert system of claim 4, in which each said remote unit is adapted for being worn by a user.

6. The security alert system of claim 5, in which each said remote unit has a cover with an attached photo identification for identifying the user thereof.

7. The security alert system of claim 6, in which a said remote unit is worn by a user stationed in a hallway of said facility for observing high traffic areas where an emergency is more likely to happen.

8. The security alert system of claim 7, in which the facility is a school and the users are faculty and staff of said school.

9. The security alert system of claim 8, wherein said receiver unit has an evacuation button thereon so that when said evacuation button is actuated an evacuation message is sent to at least one selected said remote unit.

10. A method for providing security alerts for use in a facility having rooms, hallways and other areas, comprising the steps of:

a) providing a remote unit to be carried by each of selected users in assigned areas of the facility, each remote unit having a display for receiving messages, a button for sending a signal when actuated for a specific type of an emergency condition, each remote unit being programmed to include a distinct programmed message identifying the assigned area when the button is actuated;

b) mounting an emergency box unit in each of a number of locations within the facility, each emergency box unit having a display for receiving messages, a button for sending a signal when actuated for a specific type of an emergency condition, each emergency box unit programmed for the specific location thereof, the emergency box unit having a light on an outside thereof to indicate when flashing that the emergency box unit is transmitting an emergency message thereby visually indicating to emergency responders that they have arrived at the location where the emergency message originates;

c) providing a receiver unit located within an administrative area of the facility to be monitored by security personnel and adapted for receiving and displaying all messages being transmitted from any unit, each message, indicating which remote unit is issued the message, the receiver unit having a display for receiving messages;

d) forming all of the units into a mesh network wherein each unit is in wireless communication with all other units in said network so that all units receive and display all messages; and, e) programming all of the units to interact with all other units in the network.

11. The method of claim 10, further comprising the step of providing at least four buttons on each remote unit and in each emergency box unit, a first button for indicating an intruder in the facility, a second button to indicate an incident involving a weapon, a third button to indicate a fight has broken out, and a fourth button to indicate a medical emergency.

12. The method of claim 11, further comprising the step of providing a light on each remote unit to indicate when a message is received that an evacuation should take place.

13. The method of claim 12, further comprising the step of adapting each remote unit and each receiver unit for inputting memory into the remote unit and the receiver unit.

14. The method of claim 13, wherein each remote unit is worn by a user.

15. The method of claim 14, further comprising the step of providing a cover for each remote unit with an attached photo identification for identifying the user thereof.

16. The method of claim 15, wherein the remote unit is worn by a user stationed in a hallway of the facility for observing high traffic areas where an emergency is more likely to happen.

17. The method of claim 16, wherein the facility is a school and the users are faculty and staff of said school.

18. The method of claim 17, further comprising the step of providing an evacuation button on the receiver unit so that when the evacuation button is actuated an evacuation message is sent to at least one selected remote unit.

19. The method of claim 18, wherein when any area of the facility is swept by emergency personnel, the emergency personnel can program one of the receiver units to send an evacuation signal to a selected remote unit worn by the user assigned to the selected area to evacuate the selected area.

20. The method of claim 19, further comprising the step of adapting each remote unit and each receiver unit for alerting the user that a message is being received from another remote on the network.

21. The security alert system of claim 1, in which each said emergency box unit contains a said remote unit therein.

22. The method of claim 10, further comprising the step of providing a remote unit inside the emergency box unit.

* * * * *